US010486172B2

(12) United States Patent
Saidman et al.

(10) Patent No.: US 10,486,172 B2
(45) Date of Patent: Nov. 26, 2019

(54) FORCE AMPLIFYING DRIVER SYSTEM, JETTING DISPENSER, AND METHOD OF DISPENSING FLUID

(71) Applicant: Nordson Corporation, Westlake, OH (US)

(72) Inventors: Laurence B. Saidman, Duluth, GA (US); Edward C. Taylor, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 204 days.

(21) Appl. No.: 14/961,770

(22) Filed: Dec. 7, 2015

(65) Prior Publication Data

US 2016/0089681 A1 Mar. 31, 2016

Related U.S. Application Data

(62) Division of application No. 13/511,058, filed as application No. PCT/US2010/059242 on Dec. 7, 2010, now Pat. No. 9,233,388.

(Continued)

(51) Int. Cl.
*B05B 1/30* (2006.01)
*B05C 5/02* (2006.01)

(52) U.S. Cl.
CPC ..... *B05B 1/306* (2013.01); *B05B 1/3053* (2013.01); *B05C 5/0225* (2013.01); *B05C 5/0237* (2013.01); *B05C 5/0291* (2013.01)

(58) Field of Classification Search
CPC ..... B05B 1/306; B05B 1/3053; B05B 1/08; B05C 5/0225; B05C 5/0237; B05C 5/0291

(Continued)

(56) References Cited

U.S. PATENT DOCUMENTS 2,312,877 A * 3/1943 Campbell ..... G05D 16/10 137/115.18
3,366,288 A * 1/1968 Goldschein ..... A47L 11/1625 15/50.1

(Continued)

FOREIGN PATENT DOCUMENTS

CN 1951797 A 4/2007
EP 0598182 A1 5/1994

(Continued)

OTHER PUBLICATIONS

U.S. Patent and Trademark Office, International Search Report and Written Opinion in PCT Application Serial No. PCT/US10/59242, dated Feb. 3, 2011.

(Continued)

*Primary Examiner* — Viet Le
(74) *Attorney, Agent, or Firm* — Baker & Hostetler LLP

(57) ABSTRACT

A force amplifying driver system including an actuator with a powered actuating member mounted for movement along a first distance "X". A driven member mounted for movement along a second distance or working distance "Y" which is less than the first distance "X". The powered actuating member is movable through a gap "Z" before being mechanically coupled with the driven member and subsequently moves with the driven member along the second distance "Y". Energy is transferred from the powered actuating member to the driven member along the second or working distance "Y". The force amplifying driver system may be used for actuating a fluid jetting dispenser.

20 Claims, 2 Drawing Sheets

Related U.S. Application Data

(60) Provisional application No. 61/267,583, filed on Dec. 8, 2009.

(58) Field of Classification Search
USPC ..... 239/11, 583, 93; 427/96.1; 347/54
See application file for complete search history.

(56) References Cited

U.S. PATENT DOCUMENTS 4,285,497 A * 8/1981 Gottel ..... F16K 31/105 137/625.44
4,383,264 A * 5/1983 Lewis ..... B41J 2/14201 347/47
4,711,379 A * 12/1987 Price ..... B05C 5/001 137/625.64
4,826,135 A * 5/1989 Mielke ..... B41J 2/17596 251/129.15
5,074,443 A * 12/1991 Fujii ..... B05C 5/0225 118/684
5,207,352 A * 5/1993 Porter ..... B05B 12/087 222/1
5,277,344 A * 1/1994 Jenkins ..... B05C 5/0225 222/504
5,320,250 A * 6/1994 La ..... B05C 5/0225 222/1
5,405,050 A * 4/1995 Walsh ..... B67D 3/043 222/1
5,406,989 A * 4/1995 Abe ..... G02F 1/1341 141/31
5,507,323 A * 4/1996 Abe ..... G02F 1/1341 141/31
5,535,919 A * 7/1996 Ganzer ..... B05C 5/001 222/1
5,598,200 A * 1/1997 Gore ..... B22F 9/08 347/54
5,630,550 A 5/1997 Kurishige et al.
5,662,274 A 9/1997 Koga et al.
5,747,102 A * 5/1998 Smith ..... B05C 5/001 427/98.4
5,913,455 A * 6/1999 La ..... B05C 5/0225 222/55
6,027,205 A * 2/2000 Herbert ..... B41J 2/04 222/149
6,240,905 B1 * 6/2001 Boecking ..... F02M 57/023 123/498
6,253,736 B1 * 7/2001 Crofts ..... F02M 47/027 123/467
6,253,957 B1 * 7/2001 Messerly ..... B05C 5/001 222/1
6,267,266 B1 * 7/2001 Smith ..... B05C 5/001 222/1
6,291,016 B1 * 9/2001 Donges ..... B05C 5/0225 239/419
6,354,471 B2 * 3/2002 Fujii ..... B05C 5/0225 222/325
6,537,505 B1 * 3/2003 LaBudde ..... F16K 31/0651 222/504
6,669,057 B2 12/2003 Saidman et al.
6,702,209 B2 * 3/2004 Furlani ..... B41J 2/14314 239/690
6,805,308 B2 * 10/2004 Kweon ..... B05C 5/0212 141/98
6,811,459 B2 * 11/2004 Kweon ..... B05C 5/0225 222/501
7,131,555 B2 * 11/2006 Maruyama ..... B05C 5/0225 222/1
7,694,855 B2 * 4/2010 Chastine ..... B05C 5/001 137/625.44
7,775,634 B2 * 8/2010 Silverbrook ..... B41J 2/14314 347/54
7,927,669 B2 4/2011 Schlatterbeck et al.
8,448,818 B2 * 5/2013 Ikushima ..... B05C 11/1034 222/1
8,708,246 B2 * 4/2014 Dunlap ..... G01F 11/021 239/1
8,757,511 B2 * 6/2014 Ciardella ..... B41J 2/04 239/93
8,807,400 B2 * 8/2014 Ikushima ..... B05C 11/1034 222/1
9,162,249 B2 * 10/2015 Koyama ..... B05C 5/0225
9,254,642 B2 * 2/2016 Ciardella ..... B41J 2/045
9,260,234 B2 * 2/2016 Ikushima ..... B65D 83/0005
9,339,839 B2 * 5/2016 Fliess ..... B05C 5/0225
9,346,075 B2 * 5/2016 Aguilar ..... B05C 5/0225
9,440,781 B2 * 9/2016 Ikushima ..... B05C 5/0225
2002/0002943 A1 * 1/2002 Yamakawa ..... B05C 5/0225 118/305
2002/0017238 A1 * 2/2002 Shinozaki ..... B05C 5/0258 118/668
2003/0132243 A1 * 7/2003 Engel ..... B05C 11/1002 222/61
2003/0178095 A1 * 9/2003 Kim ..... G02F 1/1341 141/98
2003/0185096 A1 * 10/2003 Hollstein ..... B01F 5/10 366/273
2005/0072815 A1 * 4/2005 Carew ..... F04B 7/0225 222/504
2005/0236438 A1 * 10/2005 Chastine ..... B05C 5/001 222/504
2006/0097010 A1 * 5/2006 Riney ..... B05C 5/001 222/146.5
2006/0157517 A1 7/2006 Fiske et al.
2007/0000303 A1 * 1/2007 Sutter ..... F02D 41/2096 73/1.72
2007/0145164 A1 * 6/2007 Ahmadi ..... B05C 5/0275 239/583
2008/0105703 A1 * 5/2008 Prentice ..... B05C 5/0225 222/63
2009/0101669 A1 * 4/2009 Hassler, Jr. ..... B05C 5/001 222/1
2009/0167818 A1 * 7/2009 Morita ..... B41J 2/04581 347/47
2010/0059021 A1 3/2010 Rau et al.
2010/0156970 A1 * 6/2010 Ikushima ..... B05B 12/06 347/8
2010/0294810 A1 * 11/2010 Ikushima ..... B05C 5/0237 222/309
2013/0052359 A1 * 2/2013 Ahmadi ..... B05C 5/0225 427/421.1

FOREIGN PATENT DOCUMENTS

EP 2143503 A1 1/2010
JP 2102053 A 4/1990
JP 07068203 3/1995
JP 861181 3/1996
JP 08128373 5/1996
JP 2000167464 A 6/2000
JP 2000262942 A 9/2000
JP 2001113212 A 4/2001
JP 2004031927 A 1/2004
JP 2004225666 A 8/2004
JP 2005534464 A 11/2005
JP 2010513768 A 4/2010
WO 2003099456 12/2003
WO 2008071531 A1 6/2008
WO 2008126373 A1 10/2008

OTHER PUBLICATIONS

U.S. Patent and Trademark Office, International Preliminary Report on Patentability in PCT Application Serial No. PCT/US10/59242, dated May 16, 2012.
Australian Patent Office, Patent Examination Report No. 1 in AU Application No. 2010328364, dated Jan. 25, 2013.
Australian Patent Office, Patent Examination Report No. 2 in AU Application No. 2010328364, dated Jan. 7, 2014.

(56) References Cited

OTHER PUBLICATIONS

European Patent Office, Supplementary Partial European Search Report in EP Application No. 10836524, dated Jan. 3, 2014.
Japanese Patent Office, Notification of Reason for Refusal in JP Application No. 2012-543199, dated Nov. 11, 2014.
The State Intellectual Property Office of the People's Republic of China, Office Action in CN Application No. 201080055894.4, dated Jan. 28, 2015.
Japanese Patent No. 5843780: Notification of Transmittal of Written Opposition dated Aug. 22, 2016, 2 pages.

* cited by examiner

FORCE AMPLIFYING DRIVER SYSTEM, JETTING DISPENSER, AND METHOD OF DISPENSING FLUID

CROSS-REFERENCE TO RELATED APPLICATIONS

This application is a divisional of U.S. patent application Ser. No. 13/511,058, filed Jul. 27, 2012, which is a national stage entry of International Patent App. No. PCT/US10/59242, filed Dec. 7, 2010, which claims the priority of U.S. Provisional Patent App. No. 61/267,583, filed Dec. 8, 2009, the disclosures of which are incorporated by reference herein.

TECHNICAL FIELD

Generally, the invention relates to driver systems for moving a driven element with quick, short acceleration, and more specifically, to jetting dispenser or valve in which a valve member is quickly accelerated to dispense or jet material onto a substrate.

BACKGROUND

Drivers for performing various work may be powered in any number of manners, such as pneumatic, hydraulic, electric, magnetic, or combinations thereof. Oftentimes, the drivers for dispensing liquids, such as hot melt materials, comprise pneumatic actuators or electro-magnetic solenoids.

Various types of jetting dispensers are known such as shown in U.S. Pat. Nos. 5,320,250; 5,747,102; and 6,253,957; and U.S. Publication No. 2006/0157517, the disclosures of which are hereby fully incorporated by reference herein. For many valve and pump devices, the size of the device is important and smaller sizes are typically preferred assuming they will perform the required function. Often, the valve element or piston is directly coupled to move with an actuator such as an air motor or pneumatic actuator, or a solenoid actuator. In such designs, when the overall size of the device is reduced, the forces available to perform the useful work (i.e., movement of the valve element or piston) are also typically reduced. Therefore, the actuator may need to be sized larger than desired if required by the amount of work to be performed. If the actuator is undersized, the performance of the device may be compromised. Direct coupling of the actuator to the device performing the work may also present challenges if the actuator is sensitive to heat and the driven element is part of a heated system. This occurs in the area of hot melt dispensing, for example, where the material being dispensed may be heated to temperatures above 250° F.

SUMMARY OF THE INVENTION

The present invention generally provides a force amplifying driver system including an actuator with a powered actuating member mounted for movement along a first distance. A driven member is mounted for movement along a second distance which is less than the first distance. The powered actuating member moves through a gap before mechanically coupling with the driven member and then moves in a mechanically coupled fashion with the driven member along the second distance. In this manner, energy is transferred from the powered actuating member to the driven member along the second distance. During its travel through the gap, the powered actuating member accelerates and creates kinetic energy which is then transferred to the driven member upon mechanical coupling (e.g., contact) and during the movement along the second distance. Thus, the powered actuating member and the driven member are mechanically coupled only during a portion of the overall travel distance of the powered actuating member. The actuator thereby delivers energy to the actuated device or driven member in an amount equal to a larger actuator in a conventional directly coupled driver mechanism. In addition, separating the actuator from the driven member enables the stroke length of the driven member to be shortened and the overall length of the actuated device or driven member to be reduced.

The driven member may comprise various elements and, in one preferred embodiment, comprises a valve member. The valve member may further comprise a valve stem with a tip engageable with a valve seat. The valve seat is located in a fluid chamber and the tip engages the valve seat at the end of the second distance to discharge a jet or small, discrete amount of the fluid. The actuator may be driven in any suitable manner, such as by using pneumatic or electric based actuators. A biased return mechanism, such as a coil spring, may be used to return the driven member to a starting position and a stop may be provided for stopping the driven member at a starting position designed to create the gap with the powered actuating member. Because the valve stem moves through a shorter stroke as compared to a directly coupled valve stem and actuator delivering the same force, a smaller dot of fluid may be dispensed. This can also be beneficial in various applications in which it would be desirable to dispense smaller, discrete amounts of fluid.

The invention further involves a method of actuating a driven member including moving an actuating member under power through a gap. The actuating member is then contacted with a driven member at the end of the gap. Once the actuating member and the driven member are mechanically coupled, they are moved together along a working distance to thereby transfer energy from the actuating member to the driven member. Other details of the method will become apparent based on the use of the device as described above and further described below.

Various additional features and details will become more readily apparent upon review of the following detailed description of an illustrative embodiment, taken in conjunction with the accompanying drawings.

DETAILED DESCRIPTION

The following detailed description will be given in the context of a fluid jetting dispenser, schematically represented, in order to illustrate principles of the invention. However, the principles may be applied to other driver systems for performing other types of work in situations, for example, in which it is desired to quickly accelerate a driven member and in which it may be desirable to minimize the size of the actuator used to move the driven member and/or to provide other benefits.

Figure 1:
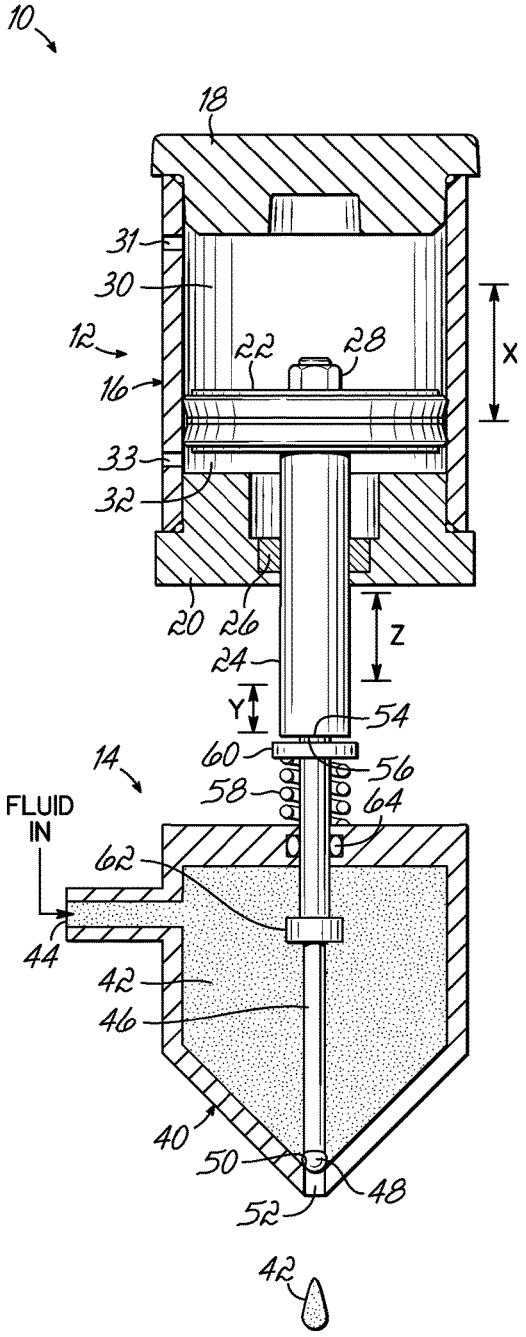
FIG. 1 is a schematic, longitudinal cross-sectional view of a fluid jetting dispenser incorporating an illustrative embodiment of the invention and showing the dispenser in a dispensing condition.
Figure 2:
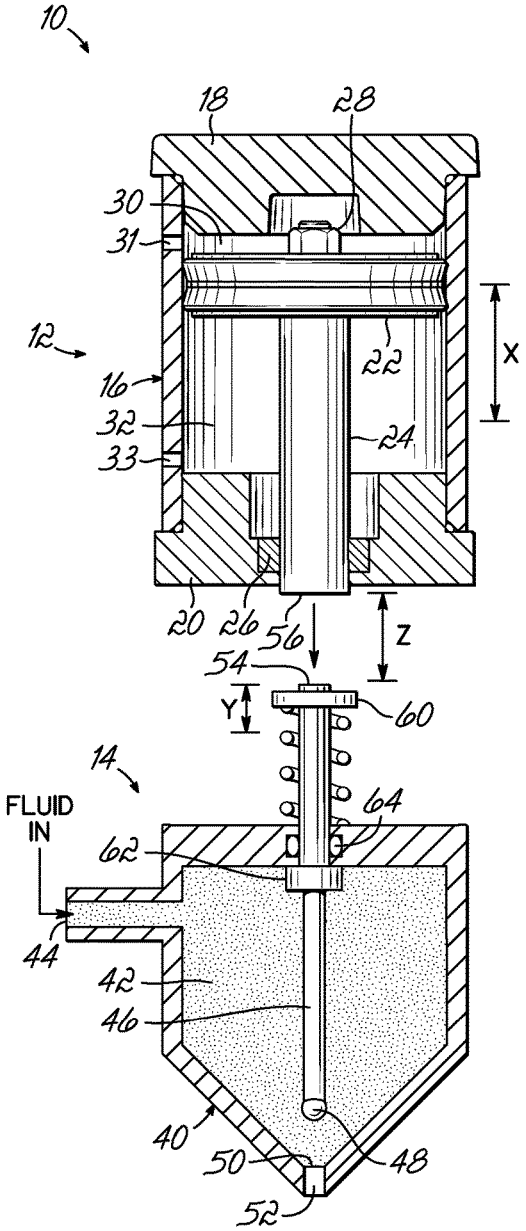
FIG. 2 is a schematic representation similar to FIG. 1, but illustrating the dispenser reset in a non-dispensing condition.

Referring to FIGS. 1 and 2, a fluid jetting dispenser 10 is illustrated and generally includes an actuator 12 and a jetting valve portion 14. Dispenser 10 is only schematically illustrated, but may include any desired design features such as any of those illustrated and/or discussed in the above-incorporated patents or publication. As mentioned, actuator 12 may comprise any numerous types of pneumatic or electric powered actuators, for example, but for illustration purposes actuator 12 is schematically shown here as a pneumatic type. The pneumatic actuator 12 generally comprises a cylinder 16 closed at opposite ends by caps 18, 20. A piston 22 is mounted for linear movement within the cylinder 16 and makes an airtight seal with the interior wall of the cylinder 16. A piston rod 24 is rigidly coupled to the piston 22 and extends through the lower cap 20 and, specifically, through a dynamic air seal 26. The piston rod 24 is rigidly coupled to the piston 22 using a suitable fastener 28. Actuator 12 is shown as a dual acting actuator with pressurizable air spaces 30, 32 respectively above and below the piston 22. As is known in the art, pressurized air is introduced through port 31 into the upper air space 30 to drive the piston 22 downward while exhausting air through port 33 from the lower air space 32. Conversely, pressurized air is introduced through port 33 into the lower air space 32 to drive the piston 22 upwardly while exhausting air through port 31 from the upper air space 30. Other manners of driving the piston 22 would include the use a conventional spring return mechanism.

The jetting valve portion 14 is schematically illustrated to include a housing 40 for containing a fluid 42 to be dispensed in a non-contact manner described below. The housing 40 includes a fluid inlet 44 for receiving fluid under pressure. The valve portion 14 further includes a valve stem 46 having a tip 48 engageable with a valve seat 50 to open and close an outlet 52. Typically, the fluid 42 is pressurized to an extent that will not cause the fluid to ooze or otherwise be dispensed when the valve stem 46 is in the upper position (FIG. 2), but instead will maintain the fluid chamber of the housing 40 in a full condition. As is known with certain types of jetting dispensers, when the valve tip 48 is accelerated against the valve seat 50, a small amount of fluid 42 will quickly discharge to form a droplet on a substrate (not shown). The opposite end of the valve stem 46 includes a surface 54 adapted to contact a surface 56 of the rod 24 as shown in FIG. 1. A coil spring 58 is positioned between a flange 60 and an upper surface of the housing 40 to maintain the valve stem 46 in the raised position shown in FIG. 2 with a stop member 62 engaged against an inside upper surface of the housing 40. The valve stem 46 engages a dynamic seal 64 to prevent fluid leakage during its travel through the housing 40.

In operation, the fluid jetting dispenser 10 starts in an initial position shown in FIG. 2 with the surface 56 separated from the surface 54 by a gap "Z." The piston 22 and attached piston rod 24 are mounted and configured to move through a first distance "X", while the valve stem 46 is configured and mounted to move through a second distance "Y" shorter than the first distance "X." The second distance "Y" may be considered the working distance which, in this case, is the stroke length of the jetting valve 14. In this regard, distance "X" equals distance or gap "Z" plus working distance or stroke length "Y." When pressurized air is introduced into the upper air space 30 through port 31, while exhausting air from air space 32 through port 33, piston 22 and piston rod 24 start to accelerate along distance "X" until they reach maximum acceleration upon contact of surface 56 with surface 54 and after traveling through the gap or distance "Z." At this point, piston rod 24 is mechanically coupled to valve stem 46 and both travel along distance "Y." Thus the kinetic energy of piston 22 and its connected piston rod 24 is transferred to valve stem 46 until tip 48 engages valve seat 50. The resulting acceleration of the tip 48 through distance "Y" and the abrupt stop occurring at valve seat 50 causes a jet of fluid 42 to be dispensed as shown in FIG. 1. The fluid 42 may be any viscous fluid, depending on the application, but examples are described in the above-incorporated patents and publication. The piston 22 is then raised by introducing pressurized air into air space 32 through port 33 and exhausting the air from air space 30 through port 31. As the piston rod 24 is being raised, the spring 58 lengthens under its normal bias to the position shown in FIG. 2 thereby raising the valve stem 46 in preparation for another dispensing cycle. The piston 22 and attached piston rod 24 are raised until they reach the starting position shown in FIG. 2 where another dispensing cycle may begin.

Figure 3:
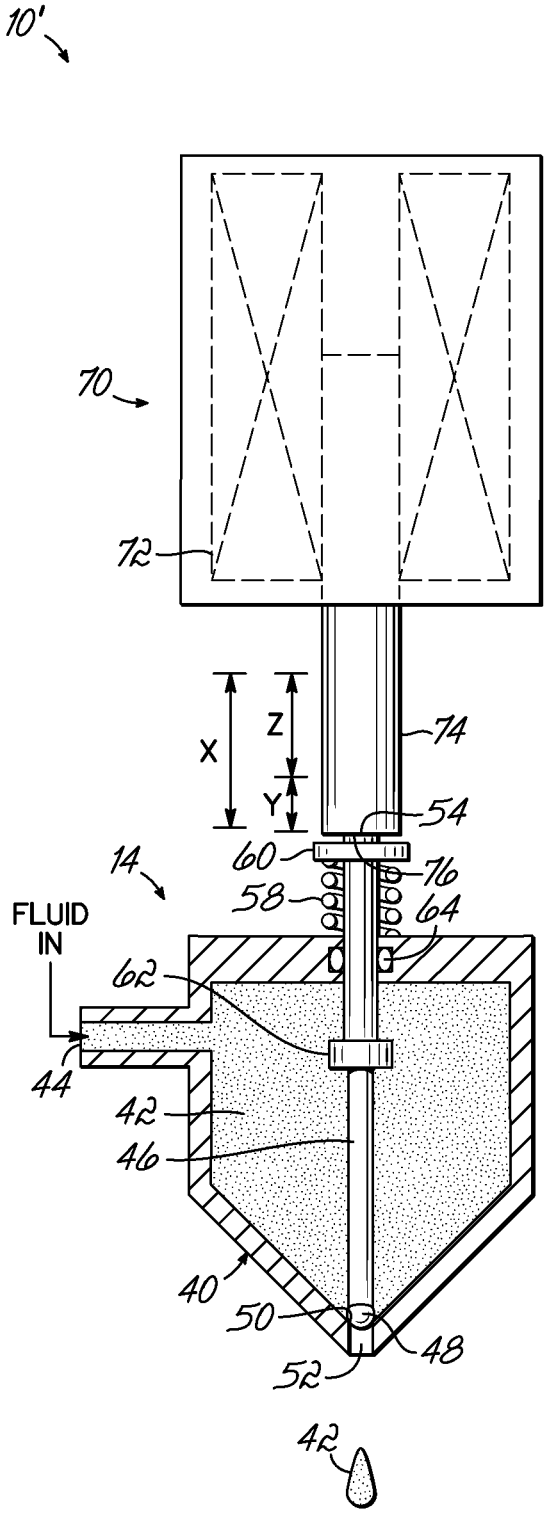
FIG. 3 is a schematic view of a fluid jetting dispenser similar to FIG. 1, but showing an alternative, electric actuator in place of the pneumatic actuator.

FIG. 3 illustrates an alternative embodiment of a fluid jetting dispenser 10'. In this embodiment, the pneumatic actuator 12 of the first embodiment has been replaced with an electric actuator, in the form of a solenoid 70. The solenoid 70, illustrated schematically, generally includes an electromagnetic coil 72 surrounding a core or poppet 74. Activation and deactivation of the solenoid 70, including the acts of energizing and de-energizing the coil 72 will cause the core or poppet 74 to reciprocate between two positions. These two positions are at the opposite ends of the distance "X" as previously described. During activation, the poppet 74 will move downward through the gap "Z" and then travel along the valve stroke length "Y" during contact between surface 76 of poppet 74 and surface 54 of valve stem 46 while dispensing a fluid droplet 42. All other reference numerals shown in FIG. 3 are identical to the numerals referencing the same structure shown and described in FIGS. 1 and 2. It will be appreciated that the poppet 74 is analogous to the previously described piston rod 24 and, except for the changes involved in substituting the electric actuator 70 for the pneumatic actuator 12, all other operations associated with the fluid jetting dispenser 10' are as described above with regard to jetting dispenser 10.

While the present invention has been illustrated by a description of the preferred embodiment and while this embodiment has been described in some detail, it is not the intention of the Applicants to restrict or in any way limit the scope of the appended claims to such detail. Additional advantages and modifications will readily appear to those skilled in the art. The various features discussed herein may be used alone or in any combination depending on the needs and preferences of the user. This has been a description of illustrative aspects and embodiments the present invention, along with the preferred methods of practicing the present invention as currently known. However, the invention itself should only be defined by the appended claims.

What is claimed is:

1. A method of jetting a droplet of hot melt adhesive using a dispenser including an actuator, and a valve including a valve member with a tip and a valve seat located in a fluid chamber, the method comprising:

moving the actuator along an axis and under power through a gap existing between the actuator and the valve member, wherein said power is selectively applied to move the actuator toward the valve member;

mechanically contacting the actuator with the valve member at the end of the gap to provide an amplifying force to the valve member; and moving the actuator and the valve member together along a working distance along the axis using the amplifying force, such that the tip of the valve member moves through the fluid chamber along the axis to abruptly engage with the valve seat at the end of the working distance causing the droplet of the hot melt adhesive to dispense from the valve.

2. The method of claim 1, wherein moving the actuator further comprises moving the actuator under pneumatic power.

3. The method of claim 1, wherein moving the actuator further comprises moving the actuator under electric power.

4. The method of claim 1, further comprising removing said power applied to the actuator, wherein, responsive to removing said power and using, at least in part, a spring bias, the valve member returns to a starting position, and wherein the tip of the valve member is disengaged from the valve seat in the starting position.

5. The method of claim 4, wherein the dispenser includes a stop coupled to the valve member within the fluid chamber, and the method further comprises:

stopping the valve member at the starting position with the stop.

6. The method of claim 4, wherein returning the valve member to a starting position further comprises:

disengaging the actuator and the valve member.

7. A jetting valve, comprising:

a housing including a fluid chamber adapted to contain hot melt adhesive, said fluid chamber further including a valve seat; and a valve member mounted for movement within the housing, said valve member including a first portion extending outwardly from the housing and configured to be operated by an actuator traveling, under selectively applied power, toward said first portion and through a gap between said actuator and said first portion prior to abruptly engaging said first portion, and a second portion within said fluid chamber and including a tip engageable with said valve seat to cause a discharge of a droplet of the hot melt adhesive.

8. The jetting valve of claim 7, further comprising a biased return mechanism operable to cause, at least in part, the valve member to return to a starting position upon removal of said power applied to the actuator, and a stop for stopping the valve member at the starting position, wherein the tip of the second portion of the valve member is disengaged from the valve seat in the starting position.

9. The method of claim 1, wherein the moving the actuator along an axis and under power through a gap existing between the actuator and the valve member comprises accelerating the actuator in a downward direction toward the valve member.

10. The jetting valve of claim 7, wherein said first portion of said valve member is further configured to be operated by said actuator accelerating in a downward direction toward said valve member.

11. The method of claim 1, wherein the hot melt adhesive is heated.

12. The method of claim 11, wherein the hot melt adhesive is heated to a temperature above 250° F.

13. The jetting valve of claim 7, wherein the hot melt adhesive is heated.

14. The jetting valve of claim 13, wherein the hot melt adhesive is heated to a temperature above 250° F.

15. The method of claim 1, wherein the axis corresponds to a longitudinal axis of the actuator.

16. The method of claim 15, wherein the axis further corresponds to a longitudinal axis of the valve member.

17. The method of claim 1, wherein the actuator contacts the valve member with a flat surface of the actuator.

18. The method of claim 17, wherein the flat surface is a flat end surface of the actuator.

19. The jetting valve of claim 7, wherein a direction of travel of the actuator through the gap corresponds to a longitudinal axis of the actuator.

20. The jetting valve of claim 7, wherein the first portion of the valve member is further configured to be abruptly engaged by a flat surface of the actuator.

* * * * *